US007004097B2

(12) United States Patent
Zeromski

(10) Patent No.: US 7,004,097 B2
(45) Date of Patent: Feb. 28, 2006

(54) PNEUMATIC BOAT EQUIPPED WITH A STABILIZING FLAP

(75) Inventor: Dominique Jean Zeromski, Villenouvelle (FR)

(73) Assignee: Zodiac International, Issy les Moulineaux (FR)

( * ) Notice: Subject to any disclaimer, the term of this patent is extended or adjusted under 35 U.S.C. 154(b) by 0 days.

(21) Appl. No.: 10/894,300

(22) Filed: Jul. 19, 2004

(65) Prior Publication Data

US 2005/0022716 A1 Feb. 3, 2005

(30) Foreign Application Priority Data

Jul. 22, 2003 (FR) ..... 03 08917

(51) Int. Cl.
*B63B 1/22* (2006.01)

(52) U.S. Cl. ..... 114/285; 114/345

(58) Field of Classification Search ..... 114/345, 114/285

See application file for complete search history.

(56) References Cited

U.S. PATENT DOCUMENTS 2,807,228 A * 9/1957 Vandre ..... 114/145 R
2,816,521 A * 12/1957 Alexander ..... 114/285
6,588,360 B1 7/2003 Bachmann

FOREIGN PATENT DOCUMENTS

| | | | |
|---|---|---|---|
| DE | 3220971 | 12/1983 | |
| DE | 3425388 | 1/1986 | |
| DE | 3448029 A1 * | 4/1986 | ..... 114/345 |
| FR | 1297889 | 7/1962 | |
| FR | 1313102 | 12/1962 | |
| FR | 1514509 | 2/1968 | |
| FR | 2756251 | 5/1998 | |

* cited by examiner

*Primary Examiner*—Stephen Avila
(74) *Attorney, Agent, or Firm*—Dean W. Russell; Kilpatrick Stockton LLP

(57) ABSTRACT

Pneumatic boat (1) including two inflatable buoyancy chambers (2) extending at least on either side and kept spaced apart by a rigid bottom and by a rear panel (6), at least one stabilizing flap (15) being secured to the base of the rear panel (6) so as to extend rearwards beyond the latter; the flap (15) is fixed to the base of the rear panel (6) by a wing (11) and screws (12) capable of allowing the flap to occupy, selectively, a functional position and a nonfunctional position; the flap (15) is dimensioned and shaped such that, in the functional position, it extends, laterally, beyond the lateral edge of the base of the rear panel (6) and such that its lateral edge (16) is engaged under the corresponding inflatable chamber (2) and simply bears freely, vertically upwards, against the latter.

5 Claims, 4 Drawing Sheets

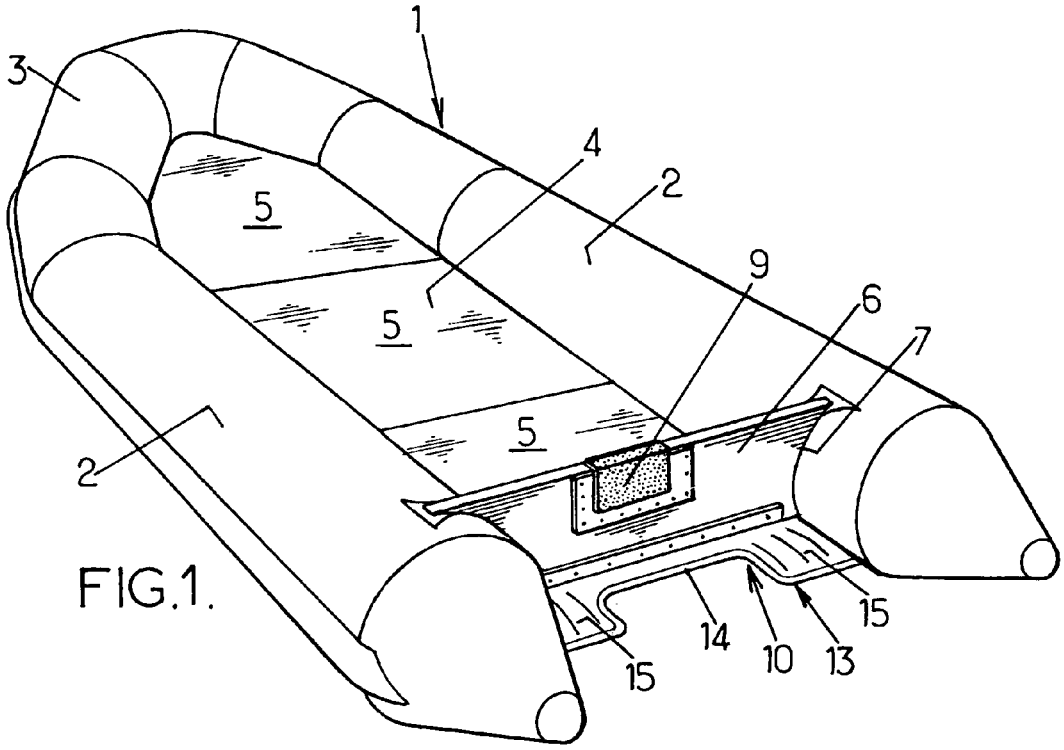
FIG.1.
FIG.2.
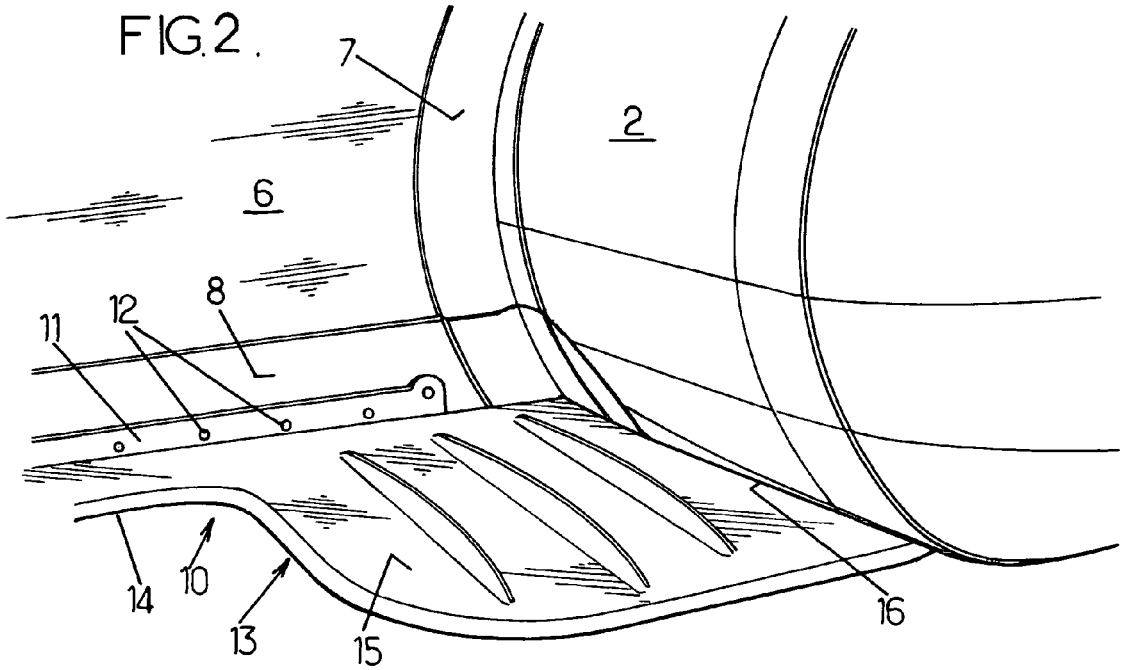

PNEUMATIC BOAT EQUIPPED WITH A STABILIZING FLAP

CROSS-REFERENCE TO RELATED APPLICATION

This application claims priority to French Application No. FR 03 08917 filed on Jul. 22, 2003, the contents of which are incorporated herein by reference.

The present invention relates to improvements made to pneumatic boats including two inflatable buoyancy chambers extending at least on either side and kept spaced apart by a rigid bottom and by a rear panel, at least one stabilizing flap being secured to the base of the rear panel so as to extend rearwards beyond the latter.

IT will be recalled that this rear flap or these rear flaps are for stabilizing the boat at least under specific navigation conditions and thus for making it safer.

Certain conditions under which the board is handled and/or certain geometrical and structural configurations of a boat of the aforementioned type involve excessive bow lift of the boat when the bow rises off the water. In particular, short boats that are laden at the rear have a tendency to experience significant bow lift. A boat that, when raised off the water, exhibits a high degree of bow lift hits the waves violently with the surface of its lower hull and, through the action of these repeated impacts, becomes difficult to steer accurately.

It is known to cancel out, or, at the very least, to reduce, the bow lift of a pneumatic boat with a rigid lower hull by providing at least one flap that extends the lower hull rearwards beyond the rear panel; an arrangement of this type, which remains structurally simple, is fully satisfactory in terms of stabilizing the boat, particularly in the case of relatively short boats that tend easily to experience bow lift. For example, document FR-A-2 756 251 proposes a special arrangement of a stabilizing rear flap of this type. However, owing to its very design (the flap is defined by rearward extensions of the rigid lower hull), this type of arrangement is reserved for pneumatic boats with a rigid lower hull or combination-hull boats.

Also known are stabilizing flap arrangements in which the flap or flaps are supported by a mounting structure or frame that is itself mounted on the rear panel, adjustment means making it possible to adjust the angular position of the flap or flaps. Nevertheless, such arrangements are bulky or complex, and are reserved for special applications (for example competition).

In point of fact, the problem of excessive bow lift referred to above is not linked to a specific type of pneumatic boat, but affects all types of pneumatic boat irrespective of their design.

The aim of the invention is thus to satisfy this requirement for all boats concerned in a simple and inexpensive manner and preferably in the form of equipment that can be adapted to users' needs, it then being possible for such equipment not only to be fitted at the stage when the boat is manufactured, but also to be sold as accessories for fitting to boats that have already been built.

For these purposes, the invention proposes a pneumatic boat such as that defined in the preamble, which is characterized in that the flap is fixed to the base of the rear panel by fixing means capable of allowing the flap to occupy, selectively, a functional position and a nonfunctional position, and in that the flap is dimensioned and shaped such that, in the functional position, it extends, laterally, beyond the lateral edge of the base of the rear panel and such that its lateral edge is engaged under the corresponding inflatable chamber and simply bears freely, vertically upwards, against the latter.

The major advantage of the stabilizing-flap means proposed by the invention lies in the fact that, in the functional position, the flap is held partly by its mechanical fixing to the lower part of the rear panel and partly by its lateral edge bearing under the adjacent inflatable chamber: this bearing action is a free bearing action and is solely the result of the pressure of the water on the flap, and no linking means connects the edge of the flap to the wall of the chamber. The relative deformability of the wall of the inflatable chamber guarantees the seal between the edge of the flap and the inflatable chamber and confers on the flap a quite satisfactory role in terms of its bow-lift stabilizing function.

By virtue of this extremely clever design, it is possible to design a flap of very simple structure that is consequently inexpensive to manufacture (synthetic materials) and, above all, is very simple to install.

In a possible embodiment, the fixing means are mounting/detaching means, the mounted position constituting the abovementioned functional position and the detached position constituting the above-mentioned nonfunctional position, and the flap can then be formed as a single-piece rigid plate.

In another possible embodiment, which is preferred owing to its ease of use and also the advantageous structural options it allows, the fixing means comprise a fixing base plate secured to the base of the rear panel, first rotation means defining a rotation pin approximately parallel to the rear panel and securing said base plate and the flap in rotation such that the flap is able to pivot between said nonfunctional position, in which the flap is raised against the rear panel, and said functional position, in which the flap is lowered in order to extend approximately transversely to the rear panel; furthermore the flap consists of two parts, namely a principal flap board, which is secured in rotation to said base plate by the abovementioned first rotation means, and a lateral flap wing, which is secured to said principal flap board on that side of the latter which faces the corresponding chamber by means of second rotation means that define a rotation pin approximately transverse to the abovementioned first pin and allow folding of said lateral flap wing against the lower face of the principal flap board in the above-mentioned nonfunctional position and the deployed positioning of said lateral flap wing substantially in the extension of said principal flap board and bearing under the corresponding inflatable chamber in the above-mentioned functional position; and, finally, first and second immobilizing means, are associated functionally with the abovementioned first and second articulation means so as to immobilize the abovementioned principal flap board and principal flap wing in their respective positions corresponding to the functional position of the flap.

This latter design is particularly advantageous since it allows the user of the boat the option of choosing to operate the boat with or without the stabilizing function, as the flap or flaps remain permanently mounted on the rear panel.

In the second preferred embodiment referred to above, it is possible, in a simple manner, to provide for the second immobilizing means to comprise a removable rod that can be engaged selectively in the aligned apertures of the principal flap board and of the lateral flap wing when the principal flap board and the lateral flap wing are both arranged in their functional position.

Also, it is advantageous for retention means to be provided in order to hold the raised flap against the rear panel.

In a possible illustrative embodiment, provision is made for two stabilizing flaps arranged on either side in the vicinity of the two respective inflatable chambers, these two flaps belonging to a single-unit piece that has an indention in its central region in order to leave the way clear for the drive down shaft of an outboard motor fixed to the rear panel.

However, in a preferred illustrative embodiment that is simple to mount on the boat, provision is made for two distinct stabilizing flaps arranged on either side in the vicinity of the two respective inflatable chambers and that can be actuated individually.

Thus, it will be understood that the stabilizing-flap means arranged in accordance with the invention may be installed on all types of pneumatic boats equipped with a rear panel, be these combination-hull boats with a rigid lower hull or boats with a flexible lower hull. Owing to their design, these flaps may be mounted when the boat is manufactured but, above all, very advantageously, they may be marketed as accessories that can be installed on boats that have already been built. Finally, the very simple structure of these flaps makes their manufacture simple and inexpensive.

The invention will be better understood on reading the following detailed description of certain embodiments that are given solely by way of nonlimiting examples. In this description, reference is made to the appended drawings, in which:

FIG. 1 is a diagrammatic view in three-quarters rear perspective of a pneumatic boat equipped with an embodiment of a flap in accordance with the invention;

FIG. 2 is a view, on a larger scale, of a portion of the boat in FIG. 1;

Figure 3:
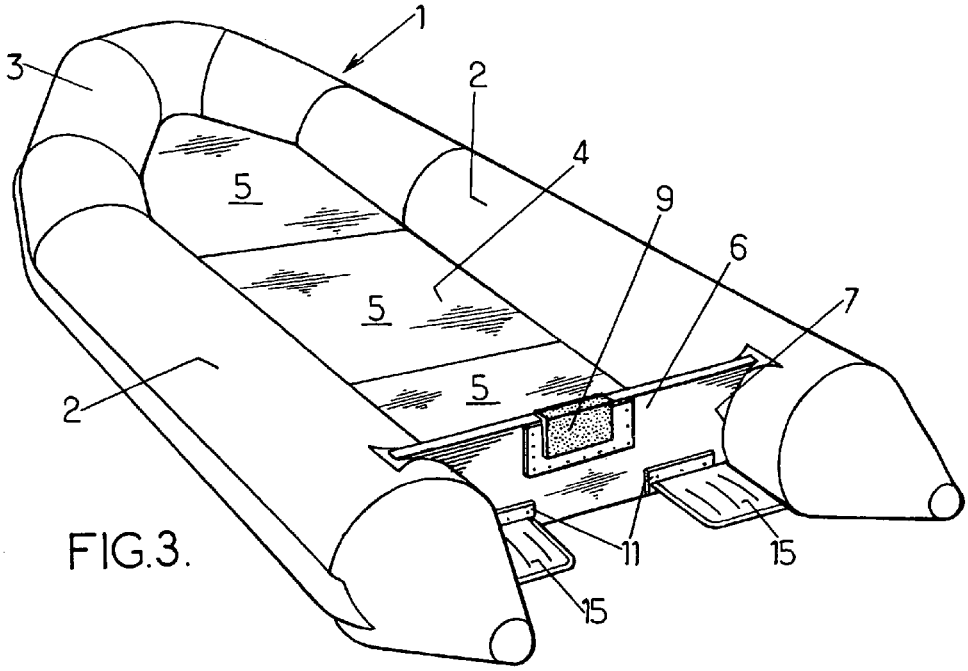
FIG. 3 is a diagrammatic view in three-quarters rear perspective of a pneumatic boat equipped with another embodiment of flaps in accordance with the invention.

FIG. 1 very diagrammatically illustrates, in perspective, a pneumatic boat 1 that, by way of example, is a boat with a flexible lower hull as it is particularly for equipping this type of pneumatic boat that the stabilizing-flap means in accordance with the invention have been developed. The boat 1 includes two inflatable buoyancy chambers 2 extending on either side and in this case meeting towards the front in the form of a stem 3. The inflatable chambers 2 are kept spaced apart by a rigid bottom 4 (shown here in the form of several abutting boards 5) and by a rear panel 6 secured in a leaktight manner both to the inflatable chambers at 7 and to the flexible lower hull (not visible) at 8, as may be seen better in FIG. 2. The rear panel 6 is, at least in its central portion, arranged (protective plate 9) in order to support an outboard motor (not shown).

In accordance with the invention, the rear panel 6 is equipped with a single-piece part 10 forming a stabilizing flap. As may be seen better in FIG. 2, on an enlarged scale, the part 10 extends over approximately the entire width of the rear panel and has, generally, an L shape, a wing 11 of which serves for fixing to the screw means 12 on the lower part of the rear panel 6 (generally made from wood) and the other wing 13 of which extends transversely to the rear panel 6. The wing 13 is shown in the general form of a plate indented at 14 in its central portion in order to allow room for the motor's drive down shaft, such that two lateral portions are defined that actually function as stabilizing flaps 15.

As may be seen better in FIG. 2, the wing 11 serving for fixing the part 10 to the rear panel 6 extends only over approximately the width of the lower part of the rear panel 6, while the flaps 15 formed by the wing 13 of the part 10 extend laterally beyond the fixing wing 11. Thus, each flap 15 is dimensioned and shaped such that it extends, laterally, beyond the rear panel and engages under the adjacent inflatable chamber 2. The lateral edge 16 of the flap 15 is shaped so as to follow the shape of this inflatable chamber 2 and so as to be applied against it through the effect of the pressure of the underlying water: by virtue of the relative flexibility of the inflatable chamber 2, a free vertical bearing action is obtained towards the relatively leaktight top of the edge 16 of the flap.

This thus constitutes a very simple arrangement of stabilizing flaps that can be fitted to any type of pneumatic boat with a rear panel, not only boats with a flexible lower hull as illustrated in FIGS. 1 and 2, but also boats with a rigid lower hull. Mounting of the single-unit part 10 by means of screws 12 is very simple, and this universal fixing makes it possible to equip new boats during manufacture just as well as boats that have already been built. This kit may be marketed in the form of an accessory that is easy for the user himself to install. Lastly, the choice of removable fixing means, in the form of screws, allows this accessory to be detached when its use is not desired and/or for folding up the deflated boat (storage/transport).

The production of the flaps 15 as a single-piece part 10 may, during mounting, facilitate correct centring by virtue of the bilateral bearing action against the two chambers 2.

However, the single-piece part 10, after detaching, is still bulky. Furthermore, it should be observed that, in the mounted position, the central, indented part 14 does not have a role in which it bears on the water.

Figure 4:
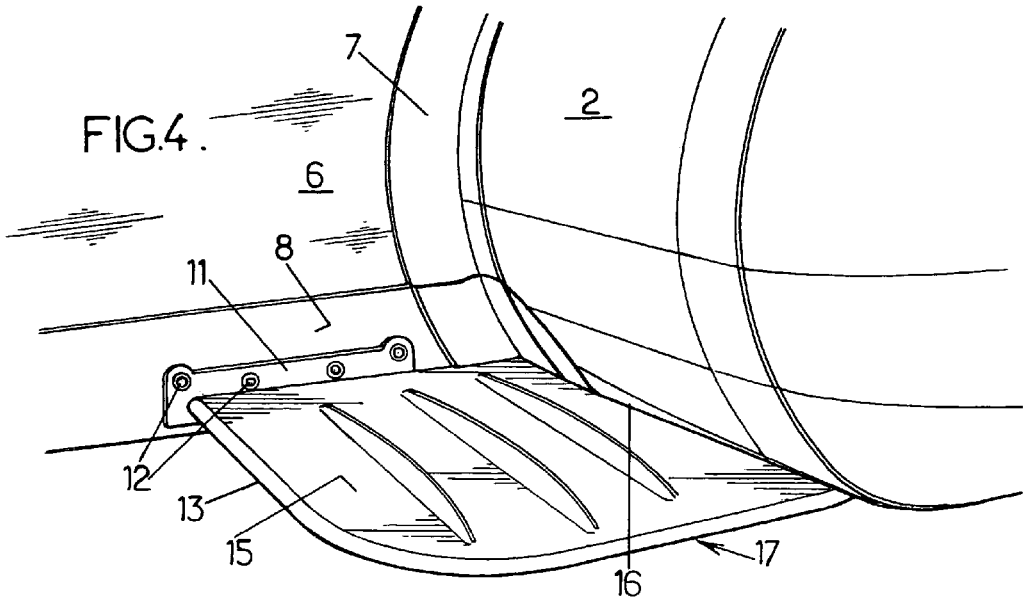
FIG. 4 is a view, on a larger scale, of a portion of the boat in FIG. 3.

For these reasons, in an advantageous embodiment it may be envisaged to form two flaps 15 as two independent parts 17, as illustrated in FIGS. 3 and 4. Each part 17 is formed as indicated above, in the form of an L, with a wing 11 for fixing to the rear panel 6 by means of screws 12 and with a wing 13 that forms the actual stabilizing flap 15, the lateral edge 16 of which is engaged under the adjacent chamber 2 and bears upwards against it. This dual embodiment of the stabilizing flaps affords the same stabilizing effect as the single-unit embodiment of FIGS. 1 and 2 since the functionally active elements—the flaps 15—are dimensioned and configured identically in both cases. Furthermore, packaging of the two parts 17 for sale in the form of spares and also their storage once detached are simplified.

Thus, the means proposed by the invention make it possible to form simple, inexpensive stabilizing flaps that are able to occupy, by virtue of rapid and simple mounting/detaching operations, two positions, namely, after mounting on the rear panel, a functional position in which the flaps 15 can fulfil their stabilizing function, and, after detaching, a nonfunctional position, in which the bow-lift effect of the boat is not attenuated.

As the abovementioned mounting/detaching operation may be deemed too restrictive by certain users, provision may be made, in accordance with the invention, for an improved embodiment of the stabilizing flaps that allows simple passage from the functional position to the nonfunctional position, or vice versa. This improved embodiment will be explained with reference to FIGS. 5A, 5B, 5C and 6 in the context of flaps 15 produced in the form of two separate parts 17, an embodiment that seems the most advantageous in practice, it being understood, however, that the arrangements that are to be explained could be transposed without difficulty in the context of the single-unit part illustrated in FIGS. 1 and 2.

The improvement now envisaged consists in providing for the possibility of mounting each flap 15 in a rotationally articulated manner such that, by means of simple rotation, the flap is able to occupy its functional position, shown in FIG. 4, or a nonfunctional position by being folded back against the rear panel 6. However, the fact that, in the functional position, the lateral edge 16 of the flap 15 is engaged under the adjacent chamber 2, prevents this rotary movement of the flap produced in single-piece form as illustrated in FIG. 4.

Therefore, the improvement referred to consists in arranging each flap 15 in the following manner.

While retaining the same general shape and the same method of fixing as the single-piece part 17 in FIGS. 3 and 4, each flap 15 is formed from several elements secured together in a rotationally articulated manner.

The fixing wing 11 of the portion 17 is formed in this case as an independent element or fixing base plate 18 that can be secured by screws 19 to the rear panel 6.

The flap 15 is formed in two portions, namely a principal flap board 20 and a lateral flap wing 21 located on the longitudinal side of the above.

The principal flap board 20 is secured to the fixing base plate 18 by first rotational securing means 22, the pin 23 of which is substantially parallel to the rear panel 6. These articulation means are arranged such that the principal flap board 20 is able to pivot over an angular field of approximately 90°, between two extreme positions, namely a raised position (shown in FIG. 5C) in which it is folded upwards against the rear panel, and a lowered position (shown in FIG. 5A) in which it extends approximately perpendicularly to the rear panel, a stop immobilizing the principal flap board 20 and preventing it from pivoting downwards beyond this position. As may be seen in FIGS. 5C and 6, these stop means may consist of an immobilizing wing 26 projecting over the lower edge of the fixing base plate 18 (the latter having the general shape of an L) and over which the principal flap board bears in its lowered position.

Figure 6:
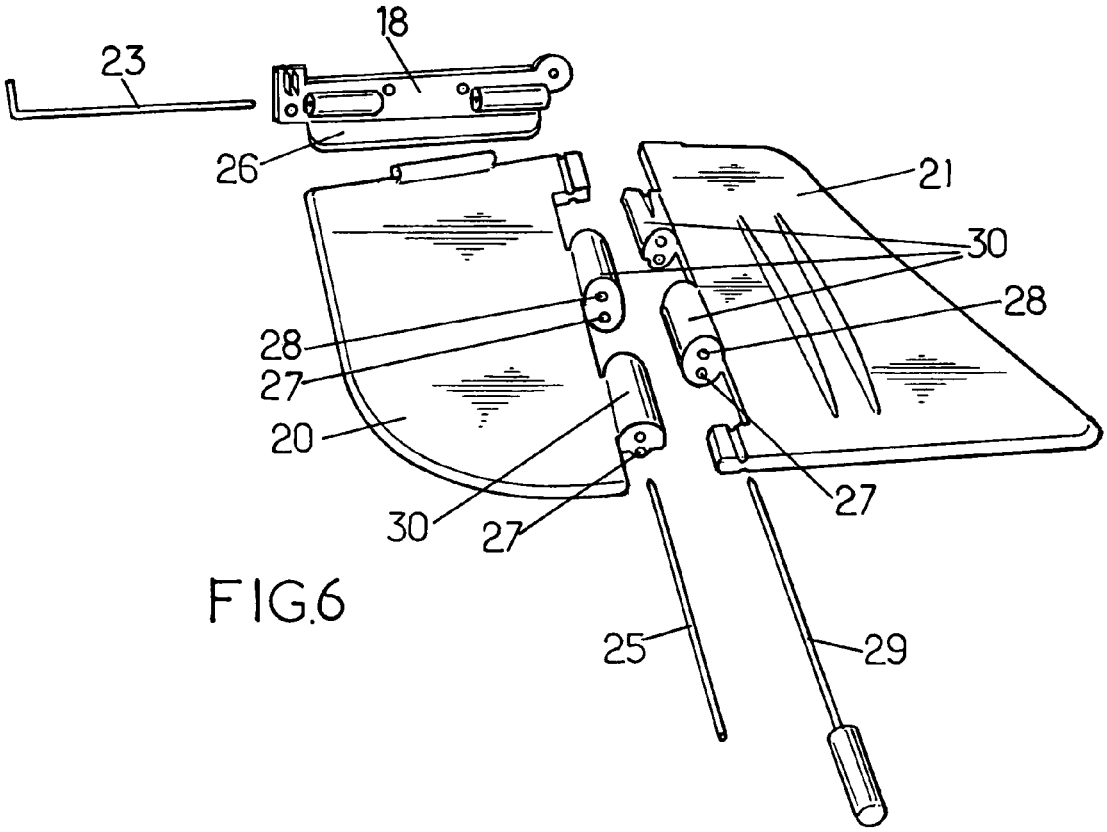
FIG. 6 is an exploded view, in perspective, of the component parts of the flap in FIGS. 5A to 5C.

The lateral flap wing 21 is secured to the principal flap board 20, along the longitudinal edge of the latter, by second rotational securing means 24, the pin 25 of which is substantially perpendicular to the abovementioned pin 23 of the first rotational securing means 22 (the pin 25 can be seen in FIG. 6).

The second securing means 24 are arranged in order to allow the lateral flap wing 21 to pivot through 120° between two extreme positions, namely a functional position (shown in FIG. 5A), in which the lateral flap wing 21 is located substantially in the extension of the principal flap board 20, the wing 21 and the board 20 together reconstituting the single-piece flap 15 of FIGS. 3 and 4, and a folded position (shown in FIG. 5C), in which the lateral flap wing 21 is folded against the lower face of the principal flap board 20.

Figure 5A:
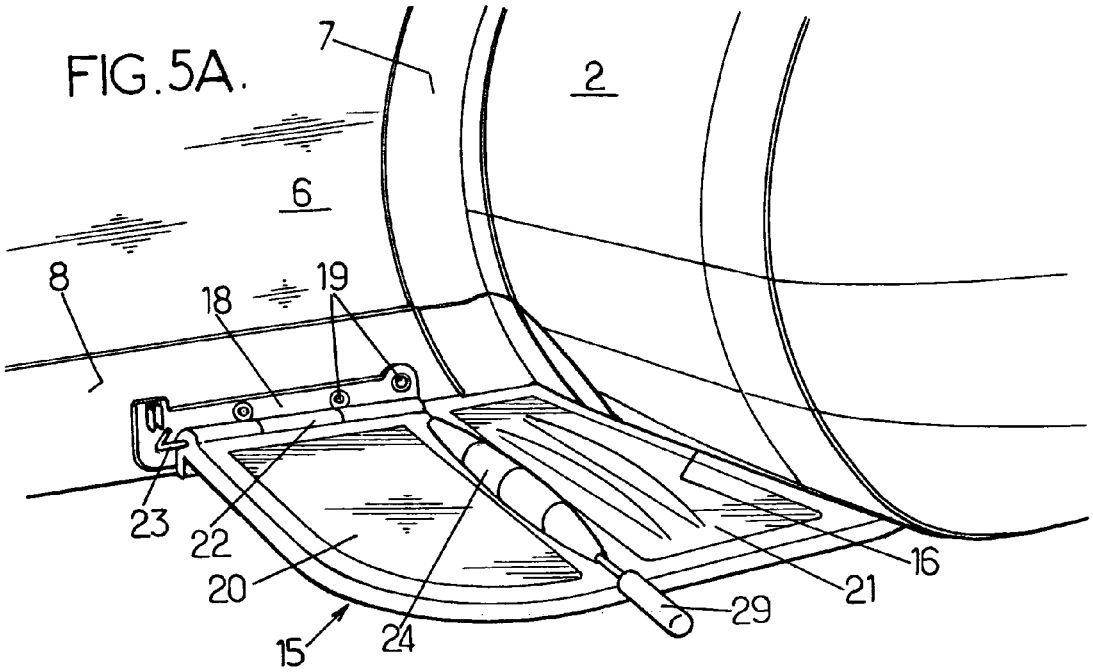
FIGS. 5A, 5B and 5C are views similar to that in FIG. 4, illustrating a preferred variant embodiment of the flap of FIG. 4 shown, respectively, in three different functional positions.

Immobilizing means are provided for keeping the lateral flap wing 21 in its functional position shown in FIG. 5A. In a simple manner, these immobilizing means are obtained by producing imbricate journals 30, provided on the respective opposing edges of the principal flap board 20 and of the lateral flap wing 21, in order to receive the rotation pin 25, each being equipped with two parallel apertures, one being a lower aperture 27 for receiving the rotation pin 25 and the other being an upper aperture 28 for receiving a removable immobilizing rod 29 (see FIG. 6).

Finally, operation of the flap 15 thus arranged is very simple.

In FIG. 5A, the flap 15 is in the functional position, the principal flap board 20 being lowered and the lateral flap wing 21 being immobilized in the extension of the board 20. The flap 15 then behaves as a single-piece flap, with the edge of the wing 21 engaged under the chamber 2 and bearing freely against it.

Figure 5B:
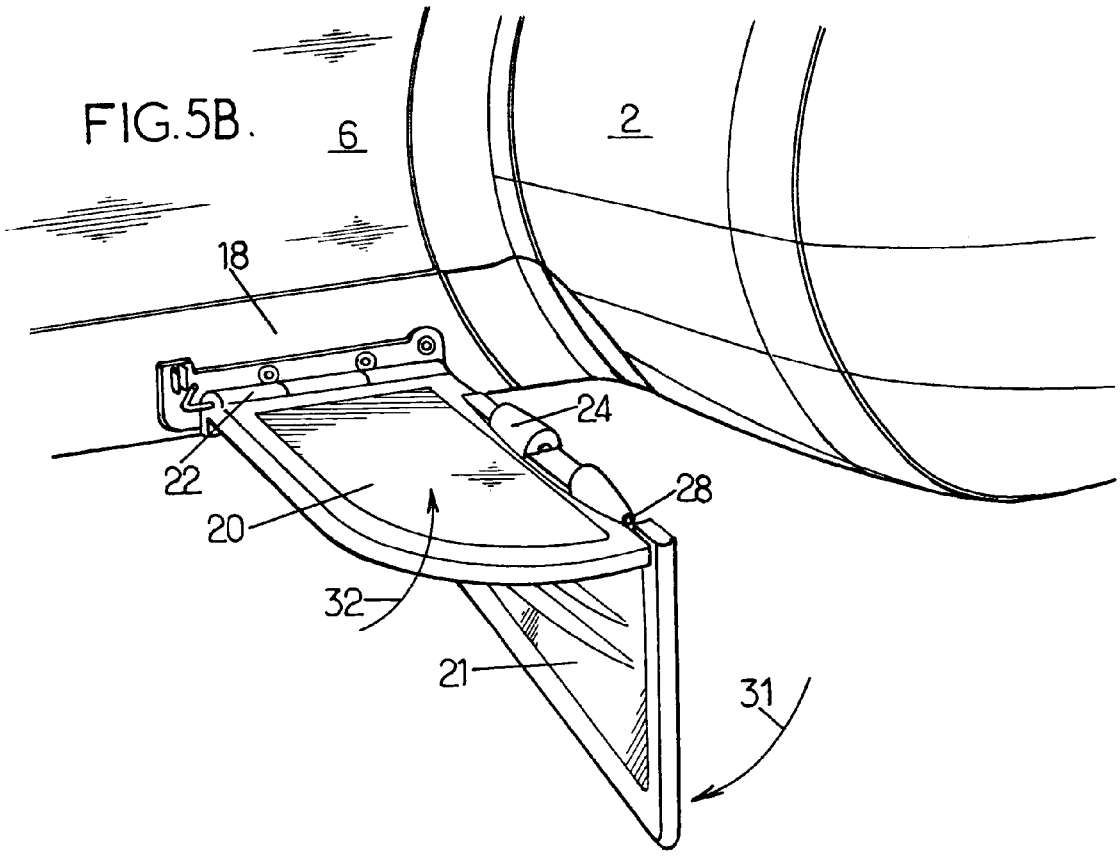

To render the flap 15 nonfunctional, the immobilizing rod 29 is removed and the lateral flap wing 21 is pivoted towards the lower face of the principal flap board 20 (arrow 31) at the same time as the principal flap board 20 is raised (arrow 32), as illustrated in FIG. 5B.

Figure 5C:
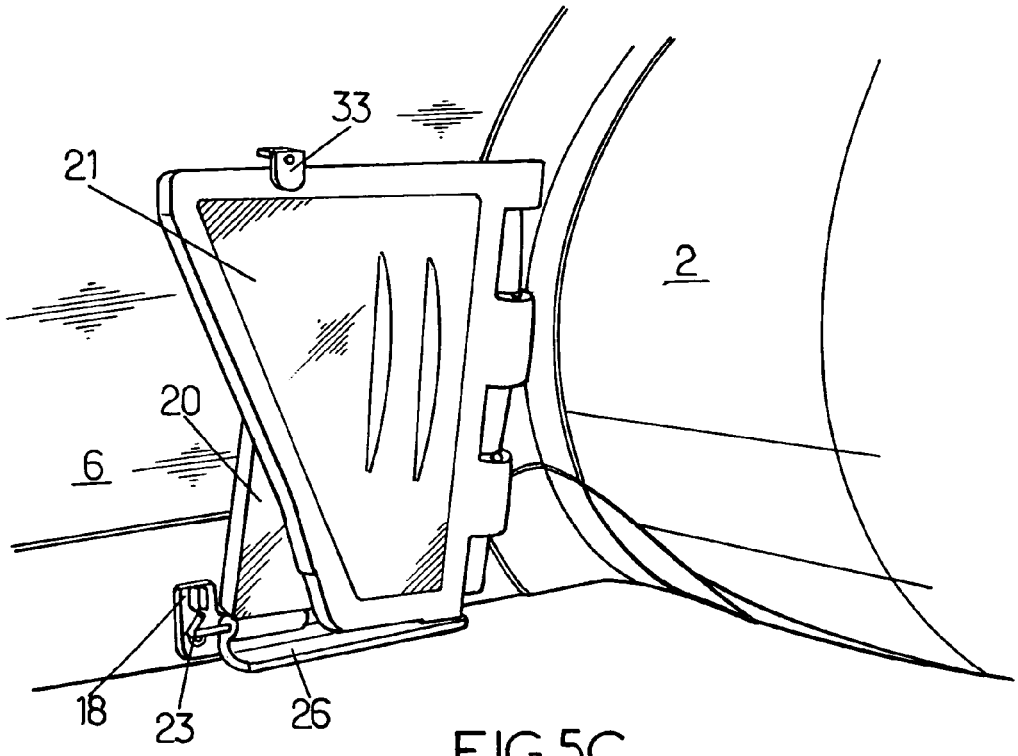

Finally, as illustrated in FIG. 5C, in the nonfunctional position, the principal flap board 20 is folded against the rear panel 6, while the lateral flap wing 21 is folded against the board 20.

The flap 15 thus folded may be held in this position by any appropriate means. A simple and inexpensive solution may consist in providing an angled tab 33 mounted pivotably on the rear panel 6 and capable of capping the edge of the wing 21.

The invention claimed is:

1. A pneumatic boat including two inflatable buoyancy chambers extending at least on either side and kept spaced apart by a rigid bottom and by a transom, at least one stabilizing flap being secured to the base of the transom so as to extend rearwards beyond said transom, wherein the flap is fixed to the base of the transom by fixing means capable of allowing the flap to occupy, selectively, a functional position and a nonfunctional position, wherein the flap comprises:

a principal flap board, which is rotatively supported by first rotation means on a base plate secured on said transom, and a lateral flap wing, which is secured to said principal flap board on that side thereof which faces the corresponding chamber by means of second rotation means approximately transverse to said first rotation means and allows folding of said lateral flap wing against the lower face of the principal flap board in said nonfunctional position and the deployed positioning of said lateral flap wing substantially in the extension of said principal flap board, said lateral flap wing being dimensioned and shaped such that, in said functional position, a lateral edge of said flap wing is engaged under the corresponding inflatable chamber and simply bears freely, vertically upwards, against said chamber, and wherein first and second immobilizing means are associated functionally with said first and second articulation means so as to lock said principal flap board and lateral flap wing in their respective positions corresponding to the functional position of the flap.

2. The boat according to claim 1, wherein said second immobilizing means comprise a removable rod that can be engaged selectively in the aligned apertures of the principal flap board and of the lateral flap wing when the principal flap board and the lateral flap wing are both arranged in their functional position.

3. The boat according to claim 1, wherein retention means are provided in order to hold the flap raised against the transom.

4. The boat according to claim 1, wherein provision is made for two stabilizing flaps arranged on either side in the vicinity of the two respective inflatable chambers, these two flaps belonging to a single-unit piece that has an indention in its central region.

5. The boat according to claim 1, wherein provision is made for two distinct stabilizing flaps arranged on either side in the vicinity of the two respective inflatable chambers.

* * * * *